US007562424B2

(12) United States Patent
Nguyen et al.

(10) Patent No.: US 7,562,424 B2
(45) Date of Patent: Jul. 21, 2009

(54) LOW-DENSITY, NON-WOVEN STRUCTURES AND METHODS OF MAKING THE SAME

(75) Inventors: Hien Nguyen, East Windsor, NJ (US); Shmuel Dabi, Highland Park, NJ (US)

(73) Assignee: Johnson & Johnson Consumer Companies, Inc., Skillman, NJ (US)

( * ) Notice: Subject to any disclaimer, the term of this patent is extended or adjusted under 35 U.S.C. 154(b) by 480 days.

(21) Appl. No.: 11/188,365

(22) Filed: Jul. 25, 2005

(65) Prior Publication Data

US 2007/0017076 A1 Jan. 25, 2007

(51) Int. Cl.
*D04H 1/46* (2006.01)

(52) U.S. Cl. ..... 28/104; 28/167

(58) Field of Classification Search ..... 28/104, 28/105, 167, 163, 169; 8/151, 148, 147, 8/149.1; 68/200, 205 R; 442/408, 387
See application file for complete search history.

(56) References Cited

U.S. PATENT DOCUMENTS

| | | | | |
|---|---|---|---|---|
| 2,862,251 | A | 12/1958 | Kalwaites et al. | |
| 3,333,315 | A | 8/1967 | Dyer et al. | |
| 3,486,168 | A | 12/1969 | Evans et al. | |
| 3,493,462 | A | 2/1970 | Bunting, Jr. et al. | |
| 3,508,308 | A * | 4/1970 | Bunting, Jr. et al. | 28/104 |
| 3,762,188 | A | 10/1973 | Bernholz et al. | |
| 3,873,255 | A * | 3/1975 | Kalwaites | 28/104 |
| 3,917,785 | A | 11/1975 | Kalwaites | |
| 4,556,601 | A | 12/1985 | Kirayoglu | |
| 4,718,152 | A | 1/1988 | Suzuki et al. | |
| 4,775,579 | A | 10/1988 | Hagy et al. | |
| 4,805,275 | A | 2/1989 | Suzuki et al. | |
| 4,910,075 | A | 3/1990 | Lee et al. | |
| 5,235,733 | A * | 8/1993 | Willbanks et al. | 28/105 |
| 5,413,849 | A | 5/1995 | Austin et al. | |
| 5,499,978 | A | 3/1996 | Buell et al. | |
| 5,584,829 | A | 12/1996 | Lavash et al. | |
| 5,791,028 | A * | 8/1998 | Zolin | 26/1 |
| 5,839,448 | A | 11/1998 | Woodlings et al. | |
| 6,030,686 | A | 2/2000 | Suehr et al. | |
| 6,253,429 | B1 | 7/2001 | Zolin et al. | |
| 6,295,706 | B1 * | 10/2001 | Strahm | 28/167 |
| 6,383,960 | B1 | 5/2002 | Everett et al. | |
| 6,442,810 | B2 * | 9/2002 | Greenway et al. | 28/104 |
| 6,694,581 | B2 | 2/2004 | Sternlieb et al. | |
| 6,877,196 | B2 | 4/2005 | Marshall et al. | |
| 2001/0041876 | A1 | 11/2001 | Creagan et al. | |
| 2002/0012792 | A1 | 1/2002 | Cinelli et al. | |
| 2002/0116801 | A1 | 8/2002 | Oathout et al. | |
| 2002/0160681 | A1 | 10/2002 | Noelle | |

(Continued)

FOREIGN PATENT DOCUMENTS

| | | | |
|---|---|---|---|
| EP | 333212 | A2 | 9/1989 |

(Continued)

*Primary Examiner*—Amy B Vanatta

(57) ABSTRACT

Provided are fibrous, non-woven structures having a drapeability of greater than about 4 gsm/g and a density less than about 0.08 g/cc, personal care articles comprising such structures, methods of making such structures including methods comprising: stabilizing a thin layer of non-woven fibers into a stabilized web; moving the stabilized web in a machine direction; and contacting the stabilized web with a stream of liquid that is directed at least partially along or against said machine direction.

16 Claims, 9 Drawing Sheets

U.S. PATENT DOCUMENTS

| | | | | |
|---|---|---|---|---|
| 2003/0088956 | A1 | 5/2003 | Strandqvist et al. | |
| 2003/0131454 | A1 | 7/2003 | Noelle | |
| 2004/0078945 | A1 * | 4/2004 | Fleissner | 28/104 |
| 2004/0093703 | A1 * | 5/2004 | Sternlieb et al. | 28/167 |
| 2006/0021205 | A1 | 2/2006 | Munstermann et al. | |
| 2007/0017075 | A1 | 1/2007 | Nguyen | |
| 2007/0123131 | A1 | 5/2007 | Nguyen | |

FOREIGN PATENT DOCUMENTS

| | | | | | |
|---|---|---|---|---|---|
| EP | 0 671 496 | A | | 9/1995 | |
| EP | 1091035 | A | | 4/2001 | |
| EP | 1 621 655 | A | | 2/2006 | |
| JP | 5033250 | | | 2/1993 | |
| SU | 432934 | | * | 6/1974 | 28/104 |
| WO | WO 99/25318 | A | | 5/1999 | |
| WO | WO 01/27373 | A1 | | 4/2001 | |
| WO | WO 03/006224 | A | | 1/2003 | |
| WO | WO 03/023106 | A2 | | 3/2003 | |
| WO | WO 2005/052237 | A2 | | 6/2005 | |

* cited by examiner

LOW-DENSITY, NON-WOVEN STRUCTURES AND METHODS OF MAKING THE SAME

FIELD OF THE INVENTION

The present invention relates generally to fibrous, non-woven structures. More specifically, the present invention relates to fibrous, non-woven structures exhibiting low-density and drapeability, and methods of making such structures.

BACKGROUND

Non-woven materials are used widely in a variety of commercially-available personal care products including, for example, wipes and feminine hygiene products, such as napkins, liners, and tampons, and the like. In many of these applications, it is desirable for the non-woven materials to be "drapeable" so as to provide comfort to the user. As used herein, the term "drapeable" refers to the tendency of a material to hang in a substantially vertical fashion due to gravity when held in a cantilevered manner from one end of the material. Materials exhibiting high drapeability tend to conform to the shape of an abutting surface, such as against a user's skin, thereby tending to enhance comfort to the user of a product comprising the high-drape material.

Applicants have recognized however that conventional materials having relatively high drapeability characteristics also tend to be relatively dense, thin, and smooth, therefore lacking in a cushiony feel and/or exfoliating properties, which may further be desired in a variety of products. For example, many relatively drapeable materials have been made conventionally via spunlacing, which process tends to produce drapeable, but highly dense, materials.

Accordingly, applicants have recognized the need for non-woven materials that exhibit the highly desirable, and unique combination of high-drape and low-density properties for use in any of a variety of articles. In addition, applicants have recognized the need for unique methods of producing such materials, including, but not necessarily limited to, methods of producing such materials via the hydroentanglement of non-wovens.

SUMMARY OF INVENTION

Applicants have overcome the disadvantages of the prior art by producing a fibrous, non-woven structure having the unique and desirable combination of relatively high drapeability and low-density properties. According to one aspect, the present invention is directed to a fibrous, non-woven structure having a drapeability of more than about 4 grams per square meter per gram (gsm/g), and a density of less than about 0.08 grams per cubic centimeter (g/cc).

Such structures may be used to great benefit in a wide variety of personal care articles. Accordingly, in another embodiment, the present invention is directed to a personal care article comprising a fibrous, non-woven structure having a drapeability of more than about 4 grams and a density of less than about 0.08 g/cc.

Applicants have further discovered unexpectedly that the low-density/high-drapeability structures of the present invention are capable of being produced via a method comprising forming a stabilized web of fibers and subsequently contacting such stabilized web with a stream of liquid in a particular direction. More specifically, according to yet another aspect, the present invention is directed to a method of producing a low-density non-woven comprising stabilizing a thin layer of non-woven fibers into a stabilized web, moving the stabilized web in a machine direction, and contacting the stabilized web with a stream of liquid that is at least partially directed along or against the machine direction.

According to yet another aspect, the present invention is directed to a method of producing a low-density non-woven comprising stabilizing a layer of non-woven fibers into a stabilized web, supporting the stabilized web on an elastomeric support member, moving the support member and stabilized web thereon in a machine direction, and contacting the supported stabilized web with a stream of liquid.

BRIEF DESCRIPTION OF THE DRAWINGS

Examples of embodiments of the present invention will now be described with reference to the drawings, in which.

DESCRIPTION OF PREFERRED EMBODIMENTS

According to certain embodiments, the present invention is directed to fibrous, non-woven structures having a unique combination of properties including, namely, relatively low-density and high drapeability as compared to conventional non-woven structures. Such unique combination of properties results in non-woven materials that are beneficially soft and comfortable, as well as, useful for providing other benefits, including cleansing or exfoliation capability, for a wide variety of articles.

As will be readily understood by those of skill in the art, the term "density" herein refers to the weight of a unit volume of a fibrous web, fabric, or portion thereof, wherein a low density relates to a web, fabric, or portion thereof, having the desirable property of bulkiness or loftiness, which tends also to correlate to the consumer-desirable perception of softness. Applicants have measured the density of the present structures via the "Density Test," described in detail below and understood by those of skill in the art. According to certain embodiments, the present structures exhibit a density that is about 0.08 g/cc or less, more preferably about 0.065 g/cc or less, and even more preferably from about 0.065 g/cc to about 0.03 g/cc. In certain preferred embodiments, the density is as low as about 0.06 or less, preferably about 0.05 or less, and even more preferably about 0.04 or less.

Applicants have also measured the drapeablility of the present structures via the "Drapeability Test", described in detail below and understood by those of skill in the art. Applicants have recognized that the present structures exhibit not only desirably low density as described above, but also exhibit relatively high drapeability in combination therewith. In particular, according to certain embodiments, the present structures exhibit a drapeability (basis weight/MCB) that is greater than about 4 gsm/g or greater, preferably greater than about 6 gsm/g, and even more preferably from about 8 gsm/g to about 16 gsm/g.

Applicants have also measured the tensile strength of the present structures via the "Tensile Strength Test," described in detail below and understood by those of skill in the art. According to certain embodiments, the present structures exhibit a tensile strength in a machine direction that is about 15 N/5 cm or more, more preferably about 20 N/5 cm or more.

In certain preferred embodiments, the present structures have a particular combination of properties, i.e., a density of less than about 0.08 g/cc, a drapeability of at least about 4 gsm/g, and optionally a tensile strength in the machine direction of at least about 15 N/5 cm. In further preferred embodiments, the present structures have a density less than about 0.065 g/cc, a drapeability of at least about 6 gsm/g, and optionally a tensile strength in the machine direction of at least about 20 N/5 cm.

Figure 1A:
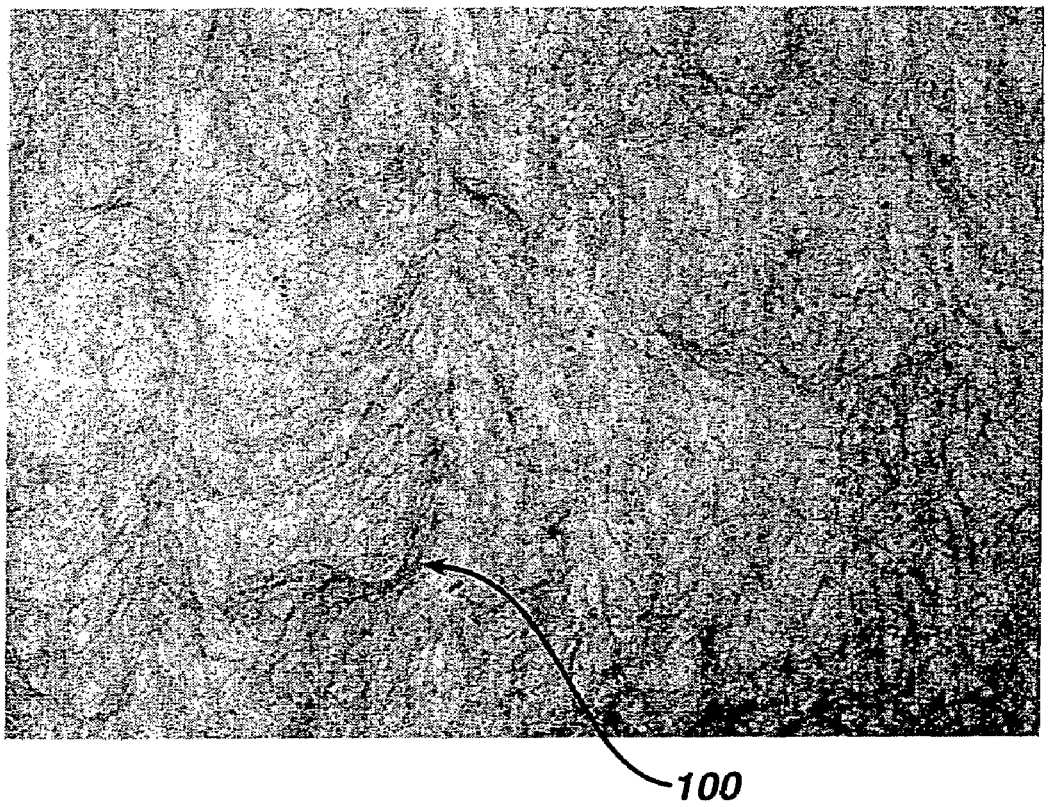
FIG. 1A is a photomicrograph, viewed in transmission, of an absorbent material consistent with certain embodiments of the present invention.

FIG. 1A is a photomicrograph, viewed in transmission, of an absorbent material consistent with certain embodiments of the present invention. According to such certain embodiments, the non-woven structures of the present invention comprise a plurality of fiber elbows 100, i.e. substantially u-shaped fiber portions that are contained within or extend outwardly from a surface 110 thereof, and are generally visible on the surface thereof.

Figure 1B:
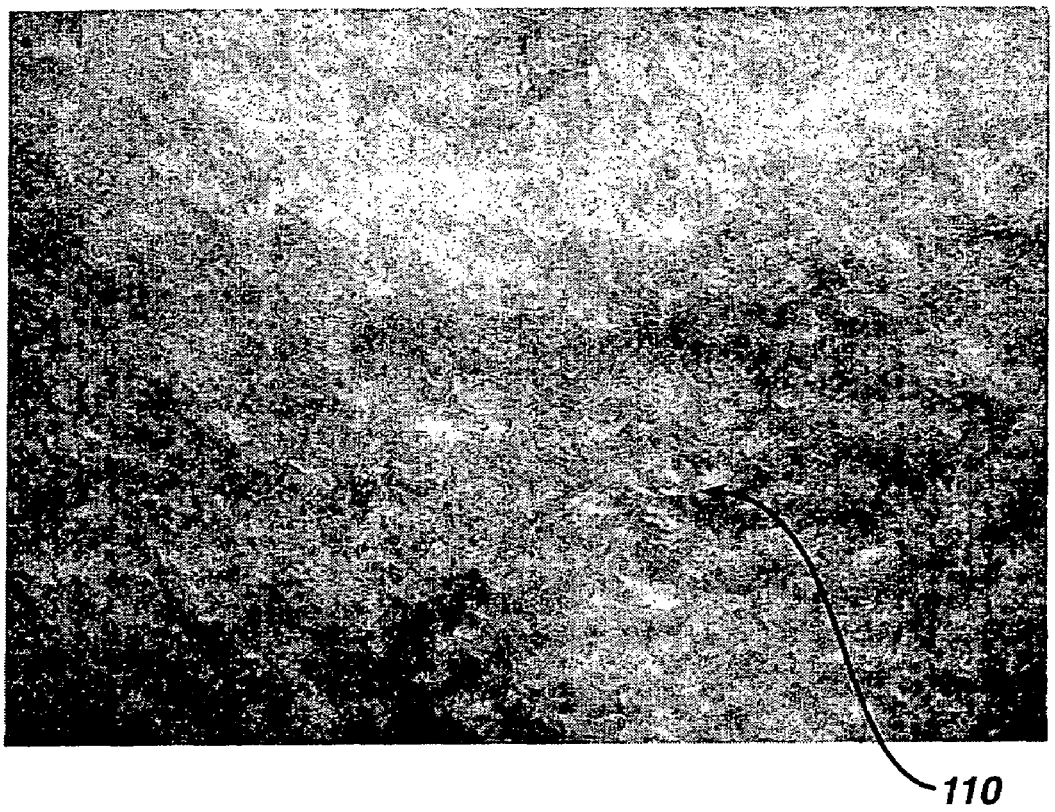
FIG. 1B is a photomicrograph, viewed in reflection, showing a surface of the material of FIG. 1A comprising nodular structures protruding from the surface.

FIG. 1B is a photomicrograph, viewed in reflection, of another absorbent material consistent with embodiments of the present invention. The entire frame of the figure represents an actual area of absorbent structure that is about 1 cm×0.75 cm. As shown in FIG. 1B, in certain embodiments, the absorbent material includes surface nodules 110, comprised of fibers and/or fiber portions, that protrude from the bulk of the structure. The surface nodules 110 may have varying shapes, such as, for example, semicircular, circular, coiled, helical, spiral, and the like and have a feature dimension (e.g., a diameter or length) from about 200 microns to about 1000 microns, preferably from about 300 microns to about 800 microns, most preferably from about 350 microns to about 700 microns. The surface nodules 110 may be present in a concentration on a surface of the absorbent structure that is greater than about 25 surface nodules per square centimeter ($cm^2$), preferably greater than about 50 surface nodules/$cm^2$, more preferably from 75 surface nodules/$cm^2$ to about 250 surface nodules/$cm^2$.

In certain embodiments, the fibrous, nonwoven structure is preferably a fibrous structure that is substantially free of fibers that are woven, knitted, tufted or stitch-bonding, i.e., the fibrous, non-woven structure is preferably made directly from fiber rather than yarn. The fibrous, non-woven structure preferably comprises or consists essentially of a plurality of fibers or filaments that are associated with one another such as by entanglement. In a preferred embodiment of the invention, the fibrous, non-woven structure is such that more than about 50% of the fibrous mass is made of fibers having a length to diameter ratio greater than about 300. While the fibers may be staple fibers or continuous filaments, it is preferred that the fibers are staple fibers. The fibers may be, for example, cellulose fibers such as wood pulp or cotton; synthetic fibers such as polyester, rayon, polyolefin, polyvinyl alcohol, multicomponent (core-sheath) fibers and combinations thereof. The fibers may be may be placed in association with one another one another using methods described in detail below.

Notable fibrous, non-woven structures comprise staple fibers, such as those derived from cellulose, polyester, rayon, polyolefin, polyvinyl alcohol, other synthetic fibers, combinations of two or more thereof, and the like. Certain preferred fibers include cellulose, polyester, rayon, and combinations of two or more thereof. Certain more preferred fibers include cellulose, and combinations of polyester and rayon. Examples of commercially available suitable fibers include "Galaxy" rayon fibers commercially available from Kelheim Fibers, Kelheim, Germany or Tencel lyocell fibers commercially available from Lenzing AG of Lenzing, Austria.

In addition to fibers, the fibrous, non-woven structure may comprise various additional materials well known in the art of the art of the manufacture of non-wovens for use in absorbent articles. For example, the fibrous, non-woven structure may comprise polymers or other chemical fiber-finishes or binders or particulate materials such as superabsorbents which may be distributed among the fibers used to enhance fluid absorption properties or pigments or other light-reflecting agents to promote a particular appearance.

In one embodiment of the invention, the thickness of the fibrous, non-woven structure so obtained has a thickness less than about 10 mm, such as less than about 2 mm. In one embodiment of the invention, the fibrous, non-woven structure so obtained has a basis weight that is less than about 150 gsm, preferably from about 30 gsm to about 90 gsm, most preferably from about 50 gsm to about 80 gsm.

In certain preferred embodiments, the non-woven structures are spun-lace structures. That is, they are materials derived from a hydroentanglement or "spun-lace" process, preferably such processes as are described herein.

Applicants have found that the structures of the present invention exhibit significantly lower density and/or drapeability, as compared to conventional fibrous, non-woven structures, especially conventional spun-lace materials. Such novel and surprising combination of properties provides significant advantage to the instant structures in a variety of uses including, but not limited to, feminine hygiene products and wipes.

In one embodiment of the invention, the fibrous, non-woven material is used as a component of a sanitary pad such as a sanitary napkin or pantiliner. For example, the fibrous, non-woven material may be a topsheet of the sanitary napkin or an integrated topsheet/absorbent core layer of a pantiliner. A top sheet or an integrated topsheet/absorbent core layer of a sanitary napkin or pantiliner comprising a fibrous non-woven material of the present invention would be advantageous in that the cover provides enhances softness, absorbency, and drapeability, all of which contribute to enhancing comfort of the wearer.

In one embodiment of the invention, the fibrous, non-woven material is used as a component of a tampon. For example, the fibrous, non-woven material may be rolled and compacted into a sliver for tampon assembly.

In one embodiment of the invention, the fibrous, non-woven material is used as a component of a wipe, e.g., a "baby wipe," a personal care/cosmetic wipe or wipe (wet or dry) useful for personal cleansing, or a wipe for the cleansing of inanimate surfaces. Fibrous non-woven materials of the present invention may be used a single layer wipe or as one or more layers in a multi-layered wipe. Preferably, the wipe includes a layer of the fibrous, non-woven material of the present invention as an "exterior" layer—such that the fibrous, non-woven material of the present invention can contact the user's skin. A wipe material comprising a fibrous non-woven material of the present invention would be advantageous in that the wipe's low density provides a feeling of softness that relates to its compressibility and absorbency.

METHODS OF THE PRESENT INVENTION

Non-woven structures of the present invention may be produced via any of a variety of novel methods discovered by applicants. For example, according to certain embodiments, the structures may be produced via a method comprising stabilizing a layer of non-woven fibers into a stabilized web, moving said stabilized web in a machine direction, and contacting said stabilized web with a stream of liquid that is at least partially directed along or against said machine direction.

Any of a variety of methods of stabilizing a layer of non-woven fibers into a stabilized web may be used according to certain embodiments of the present methods. For example, conventional methods such as hydroentanglement (i.e. directing jets of water onto the fibers to be entangled), thermobonding (i.e. applying heat, such as convection, infrared energy, and the like, to the fibers), as well latex or other "chemical" bonding and the like, and may be readily adapted by those of skill in the art for use in the present stabilizing step to provide some degree of mechanical integrity to the fibers. As will be recognized by those of skill in the art, such stabilizing methods may include any combination of steps such as providing fibers, laying fibers onto a screen via dry-laid procedures, wet-laid procedures, and/or the like, and/or orienting such fibers via carding, random fiber arrays, and/or other conventional means, and the like. According to certain preferred embodiments, the stabilizing step comprises stabilizing a layer of non-woven fibers into a stabilized web via hydroentanglement and/or thermobonding of the fibers, more preferably via hydroentanglement.

For the purposes of clarity, the following description with reference to FIGS. 2A-5 illustrates various embodiments of methods of conducting the stabilizing step according to the present invention. As shown in the particular embodiment of FIGS. 2A and 2B, the stabilizing step comprises providing a thin layer of fibers 200, which is laid onto a screen 206 (e.g. a metal or plastic screen), which in turn rests upon a movable conveyer 204. By "thin layer" it is meant an assembly of fibers that has a thickness 202 that is substantially less in dimension as compared with both a length 203 (e.g., the longest dimension of the thin layer 200) and a width 205 of said assembly. For example, the thin layer 200 may have a thickness 202 that is less than about 10% of the width 205, such as less than about 2% of the width 205. In a preferred embodiment, the thin layer 200 of fibers is substantially planar and less than about 20 mm in thickness, preferably less than about 5 mm.

The thin layer 200 of fibers are generally unbonded to one another. By "unbonded," it is meant that the fibers in the thin layer 200 are loosely associated with one another, and the layer has a very low tensile strength, such as less than about 5 N/5 cm, preferably less than about N/5 cm.

The thin layer 200 of fibers are oriented and then moved in a machine direction to jets 290 where they are contacted with streams of liquid 208 to form a stabilized web 210. It is contemplated that the streams of liquid 208 may impact the layer in any suitable direction and with any pressure suitable to form a stabilized web. Preferably, the streams of liquid 208 are oriented to impact the layer in a substantially perpendicular manner and at a pressure of for example from about 500 psi to about 5000 psi, such as from about 500 psi to about 1000 psi. As used herein, the term "substantially perpendicular" means that an angle (cf. angle 218 in FIG. 3) formed between the impinging stream of liquid and a direction normal to which the thin layer of fibers 200 is moving at the time and point of impact with the stream of liquid 208 is from about 20 degrees to about 0 degrees, preferably from about 10 to about 0 degrees, and more preferably from about 5 to about 0 degrees, and most preferably about 0 degrees.

Any suitable methods for moving the stabilized web 210 in a machine direction and contacting said stabilized web with a stream of liquid that is at least partially directed in the direction of, or against, said machine direction while said stabilized web is moving in said machine direction may be used for the instant methods. The term "machine direction" as used herein, and understood conventionally, means the direction in which the stabilized web 210 is primarily moving relative to the contacting apparatus (machine) of the contacting step.

As will be recognized by those of skill in the art, and as illustrated in the Figures, an overall machine direction 212 (depicted in FIG. 2 at various points in the process by a solid arrow) may vary relative to the contacting apparatus, depending upon the location of the web 210 on the apparatus. For the purposes of the contacting step herein, the machine direction is the direction in which that portion of the stabilized web being contacted with a stream of liquid is primarily moving, relative to the contacting apparatus (machine), at the time when it is being contacted with the stream during the contacting step.

The stabilized web 210 may be moved in the machine direction at any speed suitable for contacting the web with a stream of liquid to achieve a material of the claimed invention. In certain embodiments, the stabilized web 210 is moved in the machine direction at a speed of at least about 10 feet per minute (fpm), such as from about 50 fpm to about 250 fpm.

Applicants have recognized that, in certain embodiments, the stabilized web 210 may be contacted with a stream of liquid that is either directed along the machine direction of the web or directed against the machine direction to achieve a non-woven material of the present invention having the aforementioned combination of properties. By "directed along the machine direction," it is meant that liquid is urged (e.g., from a jet) such that just before it first contacts the stabilized web, the stream of liquid has a velocity that that has a directional component in the machine direction. Similarly, by "directed against the machine direction," it is meant that liquid is urged such that just before it first contacts the stabilized web, the stream of liquid has a velocity that that has a directional component opposite the machine direction.

Figure 2A:
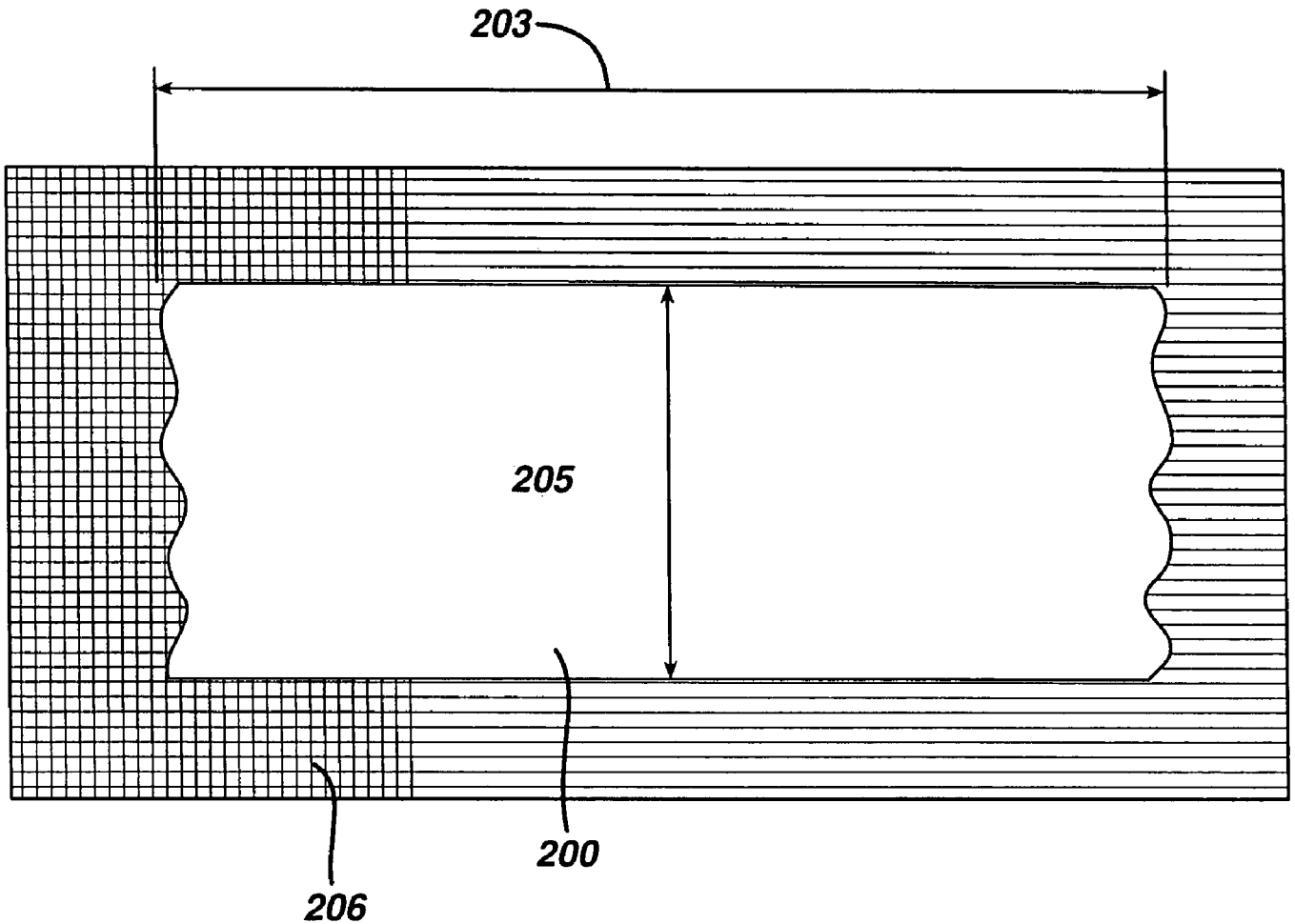
FIG. 2A is a top view of a thin layer of fibers suitable for treatment according to certain embodiments of the invention described herein, and, wherein a portion of the thin layer has been removed to show a screen positioned underneath and supporting said layer.
Figure 2B:
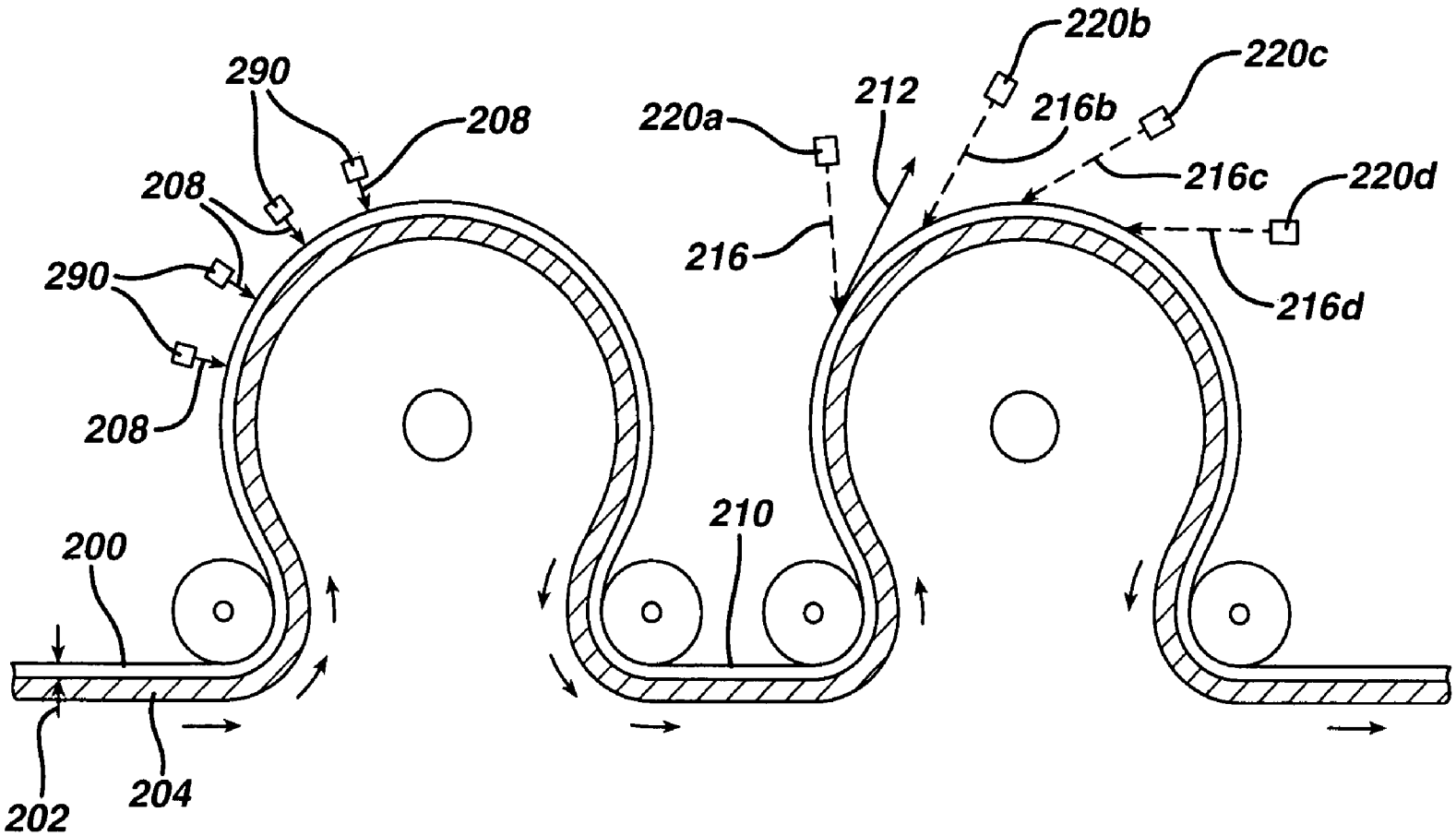
FIG. 2B is a schematic side view of the thin layer of fibers of FIG. 2A undergoing a process of treatment that is consistent with certain embodiments of the invention described herein.
Figure 3:
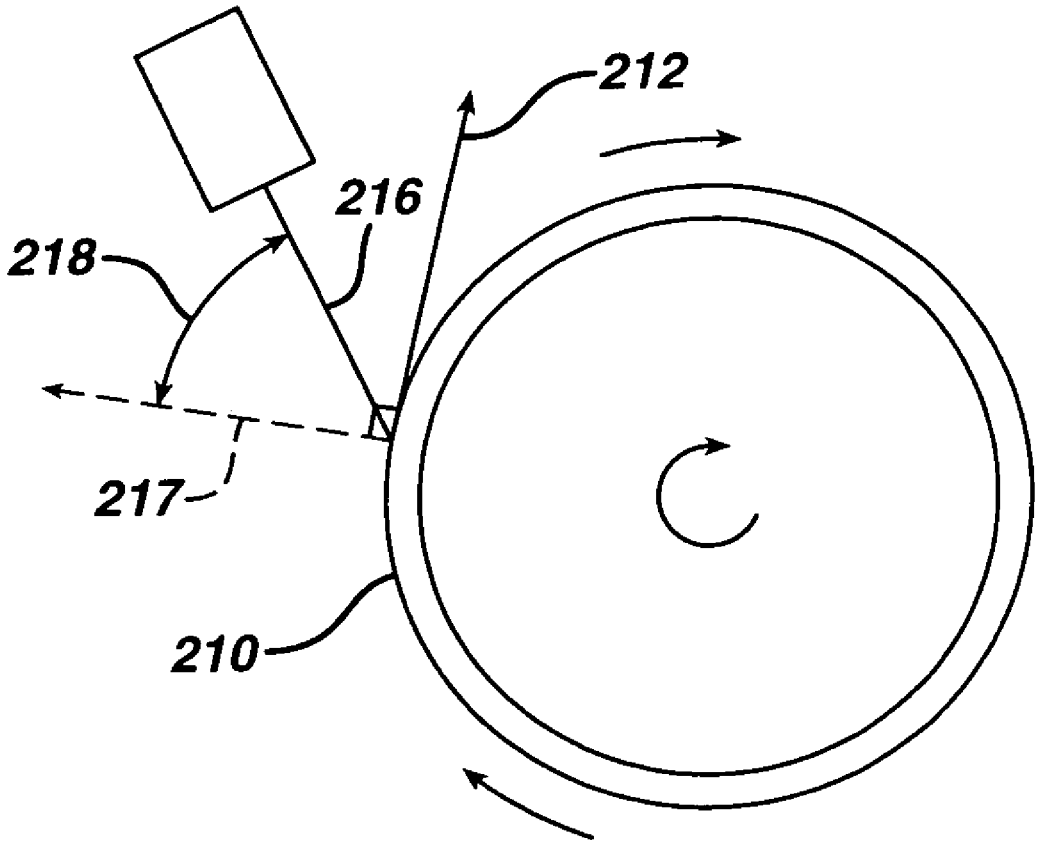
FIG. 3 is a close-up, schematic side view of a bulking station shown in FIG. 2B.

For example, FIGS. 2B and 3 illustrate embodiments of the present methods comprising streams of liquid 216 (four of such streams 216*a*, 216*b*, 216*c*, 216*d* are depicted in FIG. 2B) contacting a stabilized web 210 and directed against the machine direction 212.

As shown in FIG. 3, stream of liquid 216 hits the fiber web 210 such that the stream of liquid 216 forms an angle 218. Angle 218 is determined by measuring the angular separation (in absolute magnitude) between the stream 216 and a ray 217 normal to the surface of the stabilized web 210 at the point of contact with stream 216. The stabilized web 210 is moving in a machine direction 212 at the time of contact with the stream 216, and the stream 216 is at least partially directed against the machine direction 212.

Figure 4:
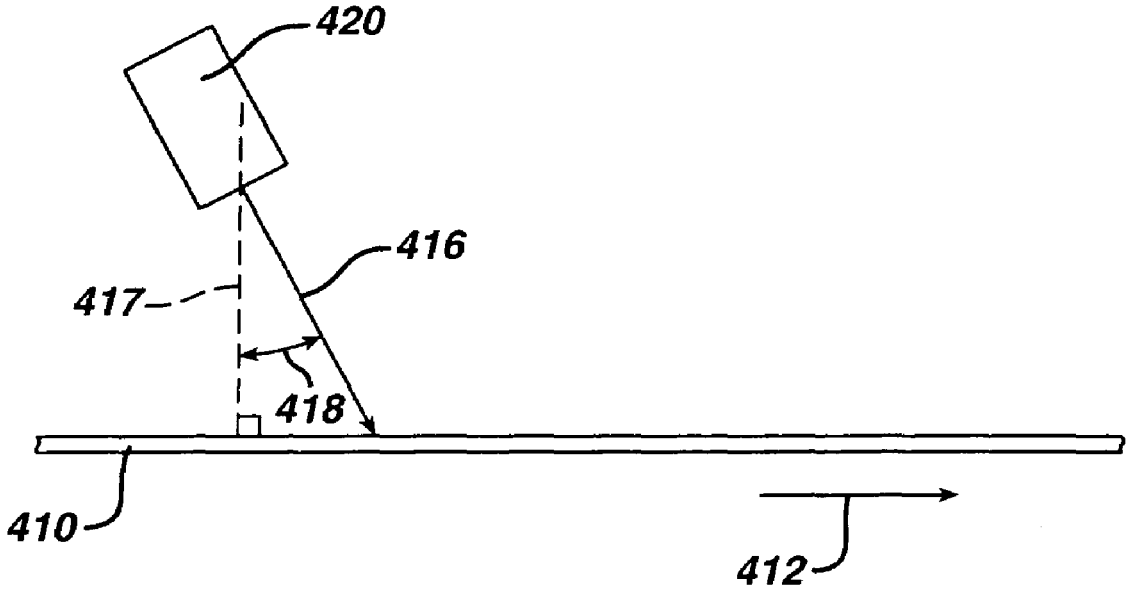
FIG. 4 is a schematic side view of a stabilized web being treated with streams of liquid consistent with certain embodiments of the invention described herein.
Figure 5:
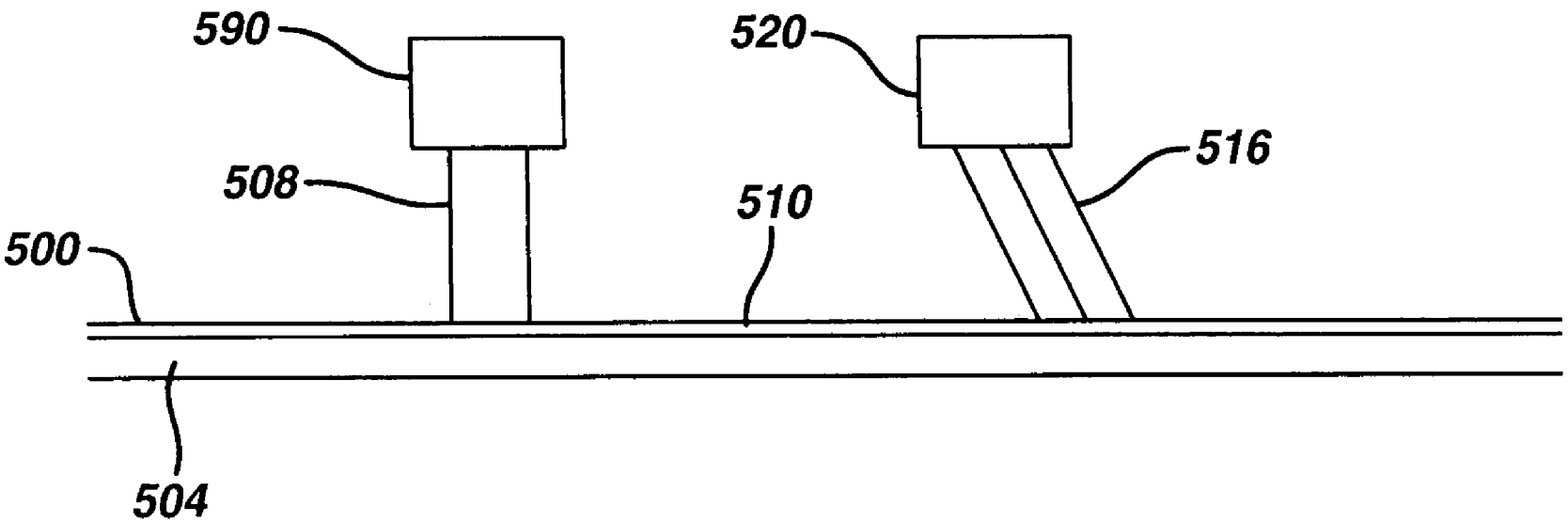
FIG. 5 is a schematic side view of a thin layer of fibers and a stabilized web undergoing a process of treatment that is consistent with certain embodiments of the invention described herein.

As shown in FIGS. 4 and 5, it is also consistent with embodiments of the invention for one or more streams to be directed along the machine direction ("machine forward" direction) for the step of contacting a stabilized web. In FIG. 4, stream 416 is directed in the machine direction 412 and impacts a stabilized web 410 to form angle 418 between stream 416 and ray 417 which is normal to the machine direction 412. FIG. 5 shows one embodiment according to the present method wherein a thin layer of fibers 500 rests on a conveyor 504 and is moved in a machine direction 512. The layer 500 is first contacted with a plurality of jets 508 which impact the layer 500 in a substantially perpendicular manner to form a stabilized web 510. The stabilized web continues to move in machine direction 512 and is subsequently contacted with a plurality of streams 516 which are directed along the machine direction 512 to form a structure of the present invention.

In one embodiment of the invention, the angle formed between a stream and a ray normal to the machine direction (for example, angle 218 or 418 as shown in the figures) is from about 1 degree to about 45 degrees, preferably from about 10 degrees to about 60 degrees, more preferably from about 15 degrees to about 30 degrees.

Any number of liquid streams and/or jets for producing such streams may be used to contact the stabilized web simultaneously or sequentially in or against the machine direction according to the contacting step. For embodiments in which there are a plurality of liquid streams for contacting the web, the streams may be spaced apart from one another, for example, in one or more rows spaced along the width or length of the web being contacted. In certain embodiments, there may be additional jets, each capable of urging a separate stream of liquid, positioned such that a given point on the stabilized web is subject to the influence of each of the additional jets as it moves in the machine direction. Furthermore, each of the additional jets may be a part of a row positioned along the width of the web. The plurality of streams and/or jets for producing such streams may be spaced apart to achieve a jet density in any suitable range, such as from about 15 to about 60 streams per inch.

In certain embodiments, the liquid streams 216 are preferably water, or predominantly water, streams. The liquid streams 216 are preferably under a pressure that is about 400 psi or greater, more preferably from about 750 psi or greater, and even more preferably from about 1000 psi to about 5000 psi. The one or more streams of liquid 216 may be such that the linear dimension/diameter characterizing an opening through which the stream is propelled or the diameter of the stream upon impact with the stabilized web may be less than about 0.3 mm, preferably from about 0.05 mm to about 0.3 mm. The liquid streams are preferably continuous streams contacting the stabilized web. Alternatively, the liquid streams may contact the web in a pulsed fashion.

For the purposes of clarity, reference is made to FIG. 2B showing a preferred contacting step according to one embodiment of the preferred embodiment. As shown in FIG. 2B, the contacting step comprises transporting a stabilized web 210 formed via a stabilizing step of the present method to a bulking hydroentanglement location 214 in order to provide loft to the stabilized web 210. Hydroentanglement location 214 comprises four jets (220*a*, 220*b*, 220*c*, and 220*d*) each of which provides a stream of liquid (216*a, b, c*, and *d*, respectively) that contact web 210 in a direction against the machine direction 212. Note that the machine direction 212 is the direction of tangency to the circular motion of the stabilized web 210 at the point of contact of stream 216 with the web 210.

The stabilization and contacting/bulking steps of the present invention are preferably conducted substantially sequentially (e.g., stabilization prior to contacting/bulking). Furthermore, while in FIG. 2B the stabilizing station 206 and the bulking station 214 are depicted on the same machine, these stations may be housed on separate machines.

The inventors have unexpectedly found that by forming a stabilized web and then contacting the stabilized web with one or more streams of liquid that are directed at least partially along or against the machine direction, one may obtain a fibrous, non-woven structure that has a low density yet sufficient mechanical integrity. The fibrous, non-woven structure so obtained may also have high drapeability. Without wishing to be bound by theory, it is believed that the inventive method loosens the stabilized web and/or reduces the degree of entanglement that is present in the stabilized web and/or increases the thickness of the stabilized web and/or decreases the density of the stabilized web. In certain preferred embodiments, applicants have recognized that the present methods allow for increasing the thickness, and/or decreasing the density, of a stabilized web by at least about 10%, preferably at least about 40%.

According to certain other embodiments, the present invention comprises methods of making a structure of the present invention comprising the steps of stabilizing a layer of non-woven fibers into a stabilized web, supporting the stabilized web on an elastomeric support member, moving the support member and stabilized web thereon in a machine direction, and contacting the supported stabilized web with a stream of liquid. The stream of liquid that contacts the supported stabilized web may be of varying orientations, e.g., substantially perpendicular to the stabilized web or at an angle relative to the stabilized web that is substantially non-zero. The stream of liquid may be directed along a machine direction, directed against a machine direction, or directed in a cross direction.

Any of the methods of stabilizing a layer of non-woven fibers into a stabilized web described above may be used to stabilize the layer of fibers. According to certain preferred embodiments, the stabilizing step comprises stabilizing a layer of non-woven fibers into a stabilized web via hydroentanglement and/or thermobonding of the fibers, more preferably via hydroentanglement.

Any suitable elastomeric material may be used to as a supporting material in the present methods. The elastomeric material may be made of any suitable material and have any configuration suitable to achieve the desired functions for any particular application of the present methods. For example, the elastomeric supporting material preferably includes an elastomeric material (a material that has a glass transition temperature below that of ambient (in use) temperature). The elastomeric may be, for example a natural (polyterpene) or synthetic elastomeric (e.g., styrenre-butadiene block copolymer, nitrile elastomers, neoprene, ethylene-propylene rubbers, urethane-based rubbers, silicone rubbers, and the like). The elastomeric may include crosslinks that are preferably irreversible with temperature changes. The elastomeric supporting material may further include fillers, pigments, reinforcing agents, plasticizers, and the like, that are compounded with the elastomeric material.

Preferably, the elastomeric material may function to contact a stabilized web on, and support it from, the side opposite of the side being contacted by one or more liquid streams in the contacting step. Without wishing to be bound by theory, it is believed that the elastomeric material permits the web and/or the stream of liquid to move in a manner that is unique as compared with conventional metal or plastic screens or supporting materials. Preferably, upon contacting the stabilized web with a stream of liquid, at least a portion of the stream travels through the stabilized web to contact the elastomeric material, whereupon such elastomeric material functions to deflect a portion of the stream of liquid back into the stabilized web.

Figure 6:
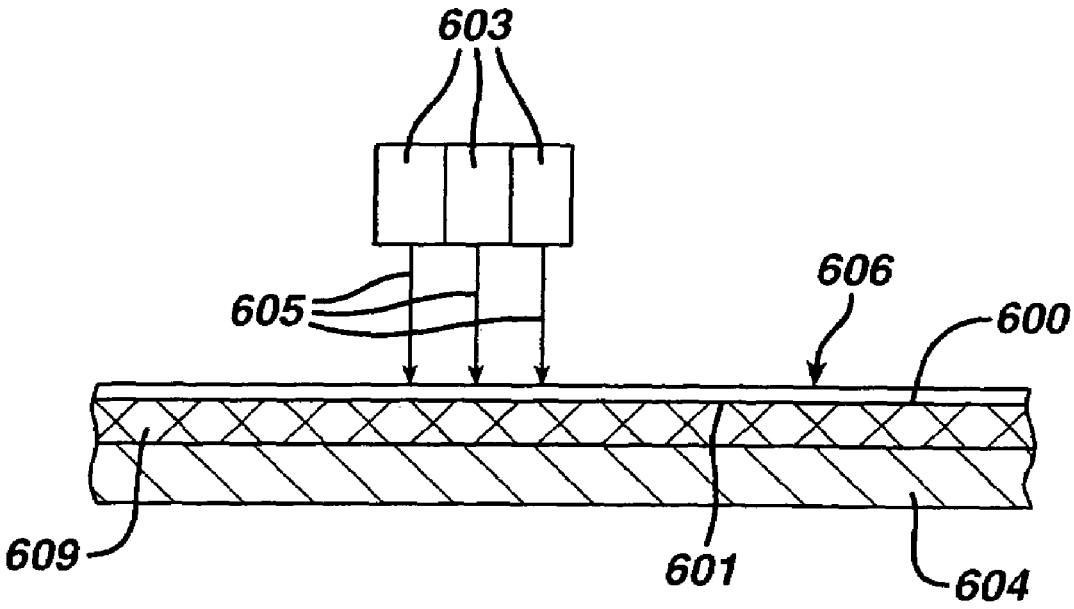
FIG. 6 is a schematic side view of a stabilized web being treated with streams of liquid consistent with certain embodiments of the invention described herein.

For example, depicted in FIG. 6 is an example of an elastomeric support material 600 and a stabilized web 609 supported thereon according to one embodiment of the present method. Elastomeric support material 609 contacts web 600 on, and supports such web from, side 601 (in this embodiment the underside of web 600). Also shown in FIG. 6 are jets 603 (collectively) which produce liquid streams 605 (collectively) that contact web on side 606 (opposite of side 601). Portions of streams 605 travel through web 600 to contact support material 609, whereupon liquid is deflected back into side 606 of web 600 to provide loft thereto. In certain preferred embodiments, the elastomeric material further functions to permit liquid to pass therethrough.

The elastomeric material may be formed into, for example, a layer or mat onto which an aperture web may be laid. The elastomeric supporting material may be apertured, for example by using a suitable laser heating source, such that it has numerous macroscopic holes through which a stream of liquid may readily pass. The shape of the holes is not critical, but the elastomeric supporting material desirably has sufficient open area (open area is the area that is occupied by holes divided by total area of holes plus material) for water to pass through readily, yet the holes preferably do not comprise an excessive portion of the elastomeric supporting materials. That is, in certain preferred embodiments, the apertured elastomeric supporting material comprises sufficient surface area to interact with the web 600 and any liquid streams passed therethrough. In certain preferred embodiments of the invention, the apertures have a dimension (e.g. a diameter) from about 0.25 mm to about 2.5 mm, preferably from about 0.25 mm to about 0.75 mm. In certain preferred embodiments, the elastomeric supporting material has an open area from about 20% to about 70%, preferably from about 25% to about 65%. In certain preferred embodiments, the elastomeric supporting material has a thickness that is from about 1 mm to about 100 mm, preferably from about 2 mm to about 10 mm, more preferably from about 3 mm to about 7 mm. In certain preferred embodiments the surface of the elastomeric support has a Shore (type A) durometer reading in the direction of the thickness of the elastomeric supporting material that is from about 20 to about 90, preferably from about 35 to about 80, most preferably from about 45 to about 70. (Shore durometer (type A) is obtained using ASTM method D2240. The indenter is placed upon the supporting material in an area that is solid, i.e., around an edge or other region which is at least about 1 cm (preferably at least about 1 inch) away from any holes. An average of 20 readings is reported.)

In certain preferred embodiments, the contacting step comprises urging a liquid stream onto a stabilized web at a pressure sufficient to deform the elastomeric support member. Examples of suitable pressures include from about 400 psi or greater, more preferably from about 750 psi or greater, and even more preferably from about 1000 psi to about 5000 psi.

From the foregoing description, one skilled in the art can ascertain the essential characteristics of this invention, and without departing from the spirit and scope thereof, can make various changes and modifications. Embodiments set forth by way of illustration are not intended as limitations on the variations possible in practicing the present invention.

EXAMPLES

The following Examples are illustrative of the present invention and are not intended to be limiting in any manner.

Example 1

In each of the following examples 1A-1H, a thin layer of fibers was placed on an 80-mesh metal screen on a rotating drum. The fibers were a blend of 70% polyester and 30% rayon having a basis weight of 65 gsm. The drum was rotated to move the layer of fibers at a linear speed of 150 fpm. All samples were subject to an initial stabilization treatment in which water was urged though each of a number of 0.005-inch diameter jets at 700 psi. The jets were in oriented perpendicularly to the layer of fibers and arranged in a row of spaced to a jet density of 30 jets/inch. The drum was allowed to rotate completely 6 times, thus allowing a given point on the layer of fibers to pass through the row of jets 6 times. Thickness was measured as described below. For certain of the examples, as indicated, an additional high pressure "bulking" treatment was performed after the stabilizing treatment. The jets (otherwise same as above) were placed at an angle of 20 degrees to the normal, either in or against the machine direction (also described as "machine forward" or "machine backward", respectively), consistent with embodiments of the invention. The samples were dewatered and passed through a thorugh-air oven to dry.

The following thickness test was performed on various thin layers of fibers and fibrous, non-woven structures to determine the thickness, according to the present invention.

Strips of material of 5 cm width are cut. To measure tensile strength in machine direction, strips are oriented such that machine direction is oriented longitudinally. To measure tensile strength in cross-machine direction, strips are oriented such that cross-machine direction is oriented longitudinally. The procedure was accomplished using an Emveco gauge using an applied pressure of 0.07 psi over a foot size of 2500 $mm^2$. The digital readout is accurate to 0.0025 cm. An average of 5 readings was recorded as the thickness. The foot of the gauge is raised and the product sample is placed on the anvil such that the foot of the gauge is approximately centered on the location of interest on the product sample. When lowering the foot, care must be taken to prevent the foot from dropping onto the product sample or from undue force being applied. The foot was lowered at a rate of 0.1 inches/second. A load of 0.07 p.s.i.g. is applied to the sample and the read out is allowed to stabilize for approximately 10 seconds. The thickness reading is then taken. This procedure is repeated for at least three product samples and the average thickness is then calculated. Density was then calculated by dividing mass of the sample by the volume (length times width times average thickness, as determined above)

The following tensile test was performed on various thin layers of fibers and fibrous, non-woven structures to determine the thickness, according to the present invention. The material is cut into strips of 2.5-cm wide and minimum of 4-inch in length. The jaws on the Instron machine are at a starting separation of 3 inch. The sample strip is grabbed by the two sets of jaws. The moving set of jaws of Instron machine is set to move at a rate of 12 in/min. The maximum load on the stress-strain curve would happen at or before the failure point, and is recorded in unit of Newtons. The end results are reported in Newtons/5 cm.

Comparative Example 1A

No additional contacting with liquid (bulking step) was performed. After the treatment, the Web had a thickness of 0.73 mm and density of 0.089 g/cm$^3$. The web tensile strength in machine direction was determined to be 65 N/5 cm. The web tensile strength in cross-machine direction was determined to be 58.2 N/5 cm.

Example 1B

After the stabilizing treatment, a bulking water treatment was performed at a pressure of 2100 psi and with jets tilted in the machine-forward direction. After the treatment, the web had a thickness of 1.68 mm and a density of 0.039 g/cm$^3$. The web tensile strength in machine direction was determined to be 29.7 N/5 cm. The web tensile strength in cross-machine direction was determined to be 18.9 N/5 cm.

Example 1C

After the stabilizing treatment, a bulking water treatment was performed at a pressure of 1500 psi and tilted in the machine forward direction. After the treatment, the web had a thickness of 1.80 mm and a density of 0.036 g/cm$^3$. The web tensile strength in machine direction was determined to be 24.9 N/5 cm. The web tensile strength in cross-machine direction was determined to be 13.4 N/5 cm.

Example 1D

After the stabilizing treatment, a bulking water treatment was performed at a pressure of 1100 psi and tilted in the machine forward direction. After the treatment, the web had a thickness of 1.80 mm and a density of 0.036 g/cm$^3$. The web tensile strength in machine direction was determined to be 41.6 N/5 cm. The web tensile strength in cross-machine direction was determined to be 33.2 N/5 cm.

Example 1E

After the stabilizing treatment, a bulking water treatment was performed at a pressure of 800 psi and tilted in the machine forward direction. After the treatment, the web had a thickness of 2.1 mm and a density of 0.031 g/cm$^3$. The web tensile strength in machine direction was determined to be 22.6 N/5 cm. The web tensile strength in cross-machine direction was determined to be 11.1 N/5 cm.

Example 1F

After the stabilizing treatment, a bulking water treatment was performed at a pressure of 1500 psi and tilted in the machine backward direction. After the treatment, the web had a thickness of 1.68 mm and a density of 0.039 g/cm$^3$. The web tensile strength in machine direction was determined to be 22.0 N/5 cm. The web tensile strength in cross-machine direction was determined to be 13.6 N/5 cm.

Example 1G

After the stabilizing treatment, a bulking water treatment was performed at a pressure of 1100 psi and tilted in the machine backward direction. After the treatment, the web had a thickness of 1.60 mm and a density of 0.041 g/cm$^3$. The web tensile strength in machine direction was determined to be 30.1 N/5 cm. The web tensile strength in cross-machine direction was determined to be 22.6 N/5 cm.

Example 1H

After the stabilizing treatment, a bulking water treatment was performed at a pressure of 800 psi and tilted in the machine backward direction. After the treatment, the web had a thickness of 1.95 mm and a density of 0.033 g/cm$^3$. The web tensile strength in machine direction was determined to be 23.7 N/5 cm. The web tensile strength in cross-machine direction was determined to be 19.1 N/5 cm.

Example 2

In each of the following examples 2A-F, the process was identical to Example 1, except for the following: (1) the fibers consisted of 50% polyester and 50% rayon having a basis weight of 75 gsm (2) the drum was rotated to move the layer of fibers at a linear speed of 100 fpm. All samples were subject to an initial stabilization treatment, in which the jets were oriented perpendicularly to the layer of fibers and arranged in a row of spaced to a jet density of 30 jets/inch. The drum was allowed to rotate completely 6 times, as for Example 1. Thickness and density were measured as for Example 1. For certain examples as indicated, an additional high pressure "bulking" water treatment was performed after the stabilizing treatment with the jets placed at an angle of 20 degrees to the normal, consistent with embodiments of the invention. The samples were dewatered and passed through a thorugh-air oven to dry.

The following absorbent capacity test was performed on various thin layers of fibers and fibrous, non-woven structures to determine the thickness, according to the present invention. A GAT (Gravimetric absorbent testing) apparatus is employed. Note that the principle of the GAT test is described in U.S. Pat. No. 4,357,827 to McConnell. The test cell is a multihole plate with a GF/A filter paper covering the holes and providing a porous medium to maintain a continuous body of test fluid in a tube connecting the reservoir and the test cell. The test fluid is 0.9% saline in deionized water. The test cell's elevation is adjusted so that the filter paper surface is cm above the fluid level in the reservoir.

The sample is die cut into a 5 cm disc. The dry weight, $W_0$ of the sample is recorded. The sample disc is placed on top of the wet filter paper on the GAT cell, a dead weight of 100 grams is placed on top of the sample, and the test is started. The amount of fluid absorbed is recorded periodically over 10 minutes by a computer. $W_1$ is the mass of fluid absorbed in 10 minutes. The absorbent capacity is the amount of fluid absorbed in grams per gram of sample: $W_1/W_0$. An average of 5 readings is reported.

Comparative Example 2A

The stabilization treatment was at 2000 psi. No additional bulking with liquid was performed. After the treatment, the web had a thickness of 1.09 mm and a density of 0.069 g/cm$^3$. The web had an absorbent capacity of 11.02 g/g.

Example 2B

After a stabilizing treatment at 2000 psi, a bulking water treatment was performed at a pressure of 1300 psi and tilted in the machine forward direction. After the treatment, the web had a thickness of 1.44 mm and a density of 0.052 g/cm$^3$. The web had an absorbent capacity of 14.09 g/g.

Example 2C

After a stabilizing treatment at 2000 psi, a bulking water treatment was performed at a pressure of 2000 psi and tilted in the machine-forward direction. After the treatment, the web had a thickness of 1.41 mm and a density of 0.053 g/cm$^3$. The web had an absorbent capacity of 14.18 g/g.

Example 2D

After a stabilizing treatment at 2000 psi, a bulking water treatment was performed at a pressure of 800 psi and tilted in the machine-forward direction. After the treatment, the web had a thickness of 1.38 mm and a density of 0.055 g/cm$^3$. The web had an absorbent capacity of 12.26 g/g.

Comparative Example 2E

The stabilization treatment was at 1200 psi. No additional contacting with liquid was performed. After the treatment, the web had a thickness of 1.11 mm and a density of 0.068 g/cm$^3$. The web had an absorbent capacity of 11.20 g/g.

Example 2F

After a stabilizing treatment at 2000 psi, a bulking water treatment was performed at a pressure of 1200 psi and tilted in the machine-backward direction. After the treatment, the web had a thickness of 1.74 mm and a density of 0.043 g/cm$^3$. The web had an absorbent capacity of 14.63 g/g.

Example 3

In each of the following examples, stabilized webs comprising fibers that are polyester/rayon blends are then laid onto a particular supporting material and treated with high pressure water jets oriented at an angle of 20 degrees forward to the stabilized web. The drum was allowed to rotate completely 4 times.

Example 3A

The fibers were 35% polyester and 65% rayon, 55 gsm. The supporting material was a conventional fine plastic (polyacetal) screen. The water pressure was 1000 psi. The resulting density measured was 0.059 g/cm$^3$, considerably less than a control sample (no bulking treatment) was 0.084 g/cm$^3$.

Example 3B

The fibers were 35% polyester and 65% rayon, 55 gsm. The supporting material was an elastomeric supporting material ⅛ inch thick and having a Shore A durometer of about 65 s (units of Shore A durometer). The water pressure was 1000 psi. The resulting density measured was 0.043 g/cm$^3$, considerably less than the control sample noted above.

Example 3C

The fibers were 35% polyester and 65% rayon, 90 gsm. The supporting material was a conventional fine metal screen. The water pressure was 1000 psi. The resulting density measured was 0.067 g/cm$^3$ considerably less than a control sample (no bulking treatment) was 0.094 g/cm$^3$ Example 3D The fibers were 35% polyester and 65% rayon, 90 gsm. The supporting material was an elastomeric supporting material ⅛ inch thick (otherwise same as in Example 3C). The water pressure was 1000 psi. The resulting density measured was 0.063 g/cm$^3$, considerably less than the control sample noted above.

Example 4

Stabilized webs comprising fibers that are polyester/rayon blends were obtained. The fibers were pre-bonded 35% polyester and 65% rayon, 55 gsm. The pre-bonded fibers were laid onto a ⅛ inch elastomeric supporting material and treated with high pressure water jets oriented perpendicularly to the stabilized web. The drum was allowed to rotate completely 4 times, advancing at 100 fpm. The water pressure was 2000 psi. The resulting density measured was 0.047 g/cm$^3$, considerably less than a control sample (the pre-bonded fibers, prior to this bulking treatment) that was 0.084 g/cm$^3$.

Example 5

Figure 7:
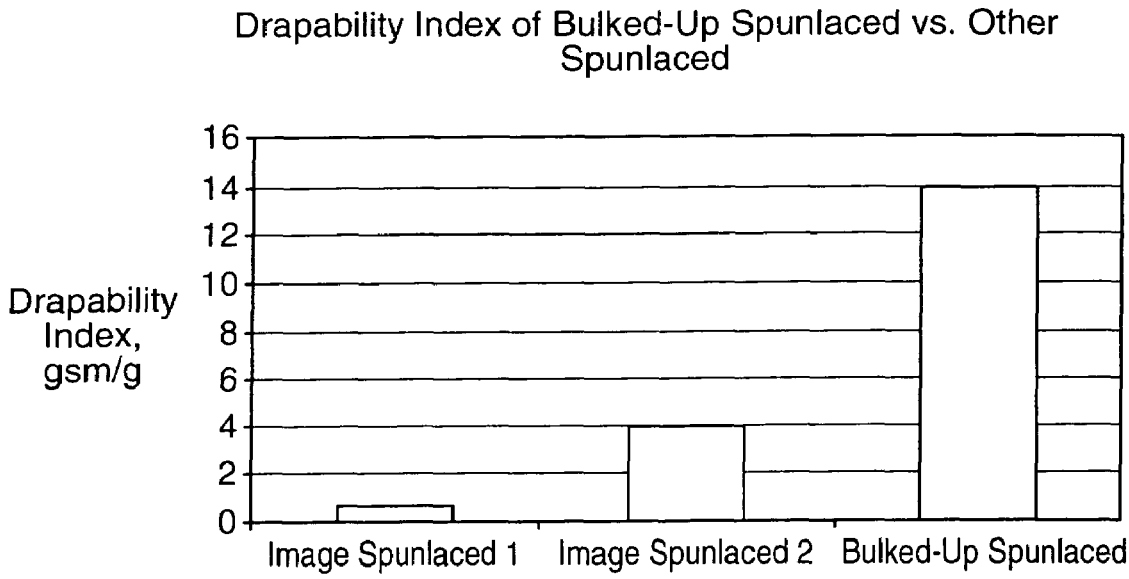
FIG. 7 is a graphical representation of the drapeability of fibrous, non-woven structure consistent with certain embodiments of the invention described herein in comparison with the drapeability of prior art structures.

In each of the following examples 5A-5C, the drapeability of various samples was tested and recorded in tabular form as shown in FIG. 7. The "Imaged Spunlaced 1" and "Imaged Spunlaced 2" shown in FIG. 7 correspond to those commercially available materials described in Comparative Examples 5A and 5B, respectively. The "Bulked Up Spunlaced" is the material of the present invention described in Example 5C. As shown in FIG. 7, the materials of the present invention have an unexpectedly, and significantly higher drapeability as compared to conventional materials.

The following drapeability test was performed on various fibrous, non-woven structures to determine the drapeability (basis weight/MCB) according to the present invention.

Modified Circular Bend Stiffness (MCB) is determined by a test that is modeled after the ASTM D 4032-82 CIRCULAR BEND PROCEDURE, the procedure being considerably modified and performed as follows. The CIRCULAR BEND PROCEDURE is a simultaneous multidirectional deformation of a material in which one face of a specimen becomes concave and the other face becomes convex. The CIRCULAR BEND PROCEDURE gives a force value related to flexural resistance, simultaneously averaging stiffness in all directions.

The apparatus necessary for the CIRCULAR BEND PROCEDURE is a modified Circular Bend Stiffness Tester, having the following parts:

1. A smooth-polished steel plate platform, which is 102.0 mm by 102.0 mm by 6.35 mm having an 18.75 mm diameter orifice. The lap edge of the orifice should be at a 45 degree angle to a depth of 4.75 mm;

2. A plunger having an overall length of 72.2 mm, a diameter of 6.25 mm, a ball nose having a radius of 2.97 mm and a needlepoint extending 0.88 mm therefrom having a 0.33 mm base diameter and a point having a radius of less than 0.5 mm, the plunger being mounted concentric with the orifice and having equal clearance on all sides. Note that the needlepoint is merely to prevent lateral movement of the test specimen during testing. Therefore, if the needle-point significantly adversely affects the test specimen (for example, punctures an inflatable structure), than the needle-point should not be used. The bottom of the plunger should be set well above the top of the orifice plate. From this position, the downward stroke of the ball nose is to the exact bottom of the plate orifice;

3. A force-measurement gauge and more specifically an Instron inverted compression load cell. The load cell has a load range of from about 0.0 to about 2000.0 g;

4. An actuator and more specifically the Instron Model No. 1122 having an inverted compression load cell. The Instron 1122 is made by the Instron Engineering Corporation, Canton, Mass.

In order to perform the procedure for this test, as explained below, three representative samples for each article are necessary. The location of the non-woven structure to be tested is selected by the operator. A 37.5 mm by 37.5 mm test specimen is cut from each of the three samples at corresponding locations. Prior to cutting the samples any release paper or packaging material is removed and any exposed adhesive, such as garment positioning adhesive, is covered with a non-tacky powder such as talc or the like. The talc should not affect the BW and MCB measurements.

The test specimens should not be folded or bent by the test person, and the handling of specimens must be kept to a minimum and to the edges to avoid affecting flexural-resistance properties.

The procedure for the CIRCULAR BEND PROCEDURE is as follows. The specimens are conditioned by leaving them in a room that is 21° C., +/−1° C. and 50%, +/−2.0%, relative humidity for a period of two hours.

The weight of each cut test specimen is measured in grams and divided by a factor of 0.0014. This is the basis weight in units of grams per square meter (gsm). The values obtained for the basis weight for each of the samples is averaged to provide an average basis weight (BW). This average basis weight (BW) may then be utilized in the formulas set forth above.

A test specimen is centered on the orifice platform below the plunger such that the body facing layer of the test specimen is facing the plunger and the barrier layer of the specimen is facing the platform. The plunger speed is set at 50.0 cm per minute per full stroke length. The indicator zero is checked and adjusted, if necessary. The plunger is actuated. Touching the test specimen during the testing should be avoided. The maximum force reading to the nearest gram is recorded. The above steps are repeated until all of three test specimens have been tested. An average is then taken from the three test values recorded to provide an average MCB stiffness. This average MCB value may then be used in the formulas set forth above. Drapeability is calculated as basis weight divided by the average MCB value determined above.

Comparative Example 5A

An imaged spun-lace material, commercially available from PGI was tested. It had a basis weight of 70 gsm, consisting of 75% polyester and 25% rayon in two layers. The MCB was determined to be 95 g. The drapeability was calculated as 0.74 gsm/g.

Comparative Example 5B

An imaged spun-lace material was tested. It had a basis weight of 75 gsm and was a homogeneous blend of 75% polyester and 25% rayon. The MCB was determined to be 19 g. The drapeability was calculated as 3.95 gsm/g.

Example 5C

A sample made from 65 gsm, consisting of 65% rayon and 35% polyester was made in a manner consistent with embodiments of the present invention. The MCB was determined to be 4.7 g. The drapeability was determined to be 13.83 gsm/g.

Example 6A

An absorbent structure was made by stabilizing a thin layer of fibers (35% PET, 65% rayon) by entangling the fibers using perpendicular jets at 600 psi to form a stabilized web. The layer of fibers had a base weight of 63 gsm. The stabilized web was treated with water jets at 1200 psi oriented at an angle of about 20 to about 25 degrees to normal directed along the machine direction. The stabilized web was supported by a conventional metal mesh screen. The resulting structure had a density of 0.064 g/cc and a tensile strength in the machine direction of 21 and a tensile strength in the cross direction of 14. A dark field photomicrograph of this material is shown in FIG. 1A.

Example 6B

An absorbent structure was made by stabilizing a thin layer of fibers (35% PET, 65% rayon) by entangling the fibers using perpendicular jets at 600 psi to form a stabilized web. The layer of fibers had a basis weight of 110 gsm. The stabilized web was treated with water jets at 1200 psi oriented at an angle of about 20 to about 25 degrees to normal directed along the machine direction. The stabilized web was supported by a polyacetal screen. The resulting structure had a density of 0.071 g/cc and a tensile strength in the machine direction of 19 and a tensile strength in the cross direction of 4. A photomicrograph of this material is shown in FIG. 1B.

Table 1 shows materials made or tested in the above Examples and Comparative Examples, and the density, tensile strength, absorbence, and drapeability associated therewith. Such values clearly illustrate the advantageous and surprisingly unique combination of properties associated with the materials of the present invention as compared to conventional, comparable materials.

TABLE 1

| | Polyester (wt. %) | Rayon (wt. %) | Basis weight (gsm) | Pressure, Bulking (psi) | Angle, Bulking step (Degrees) | Density (g/cc) | Tensile, machine | Tensile, Cross-machine | Abs Cap | Drape |
|---|---|---|---|---|---|---|---|---|---|---|
| Comparative Sample 1A | 70 | 30 | 65 | — | — | 0.089 | 65 | 58.2 | ND | ND |
| Inventive Sample 1B | 70 | 30 | 65 | 2100 | 20, forward | 0.039 | 29.7 | 18.9 | ND | ND |
| Inventive Sample 1C | 70 | 30 | 65 | 1500 | 20, forward | 0.036 | 24.9 | 13.4 | ND | ND |
| Inventive Sample 1D | 70 | 30 | 65 | 1100 | 20, forward | 0.036 | 41.6 | 33.2 | ND | ND |

TABLE 1-continued

| | Polyester (wt. %) | Rayon (wt. %) | Basis weight (gsm) | Pressure, Bulking (psi) | Angle, Bulking step (Degrees) | Density (g/cc) | Tensile, machine | Tensile, Cross-machine | Abs Cap | Drape |
|---|---|---|---|---|---|---|---|---|---|---|
| Inventive Sample 1E | 70 | 30 | 65 | 800 | 20, forward | 0.031 | 22.6 | 11.1 | ND | ND |
| Inventive Sample 1F | 70 | 30 | 65 | 1500 | 20, backward | 0.039 | 22.0 | 13.6 | ND | ND |
| Inventive Sample 1G | 70 | 30 | 65 | 1100 | 20, backward | 0.041 | 30.1 | 22.6 | ND | ND |
| Inventive Sample 1H | 70 | 30 | 65 | 800 | 20, backward | 0.033 | 23.7 | 19.1 | ND | ND |
| Comparative Sample 2A | 50 | 50 | 75 | — | — | 0.069 | ND | ND | 11.02 | ND |
| Inventive Sample 2B | 50 | 50 | 75 | 1300 | 20, forward | 0.052 | ND | ND | 14.09 | ND |
| Inventive Sample 2C | 50 | 50 | 75 | 2000 | 20, forward | 0.053 | ND | ND | 14.18 | ND |
| Inventive Sample 2D | 50 | 50 | 75 | 800 | 20, forward | 0.055 | ND | ND | 12.26 | ND |
| Comparative Sample 2E | 50 | 50 | 75 | — | — | 0.068 | ND | ND | 11.2 | ND |
| Inventive Sample 2F | 50 | 50 | 75 | 1200 | 20, backward | 0.043 | ND | ND | 14.63 | ND |
| Inventive Sample 3A | 35 | 65 | 55 | 1000 | 20, forward | 0.059 | ND | ND | ND | ND |
| Inventive Sample 3B (elastomeric forming member) | 35 | 65 | 55 | 1000 | 20, forward | 0.043 | ND | ND | ND | ND |
| Inventive Sample 3C | 35 | 65 | 55 | 1000 | 20, forward | 0.067 | ND | ND | ND | ND |
| Inventive Sample 3D (elastomeric forming member) | 35 | 65 | 90 | 1000 | 20, forward | 0.063 | ND | ND | ND | ND |
| Inventive Sample 4 (elastomeric forming member) | 35 | 65 | 55 | 2000 | 0 | 0.047 | ND | ND | ND | ND |
| Comparative sample 5A | | | | | | | | | | 2 |
| Comparative sample 5B | | | | | | | | | | 1 |
| Comparative sample 5C | | | | | | | | | | 4 |
| Inventive Sample 5D | | | | | | | | | | 13.X |

We claim:

1. A method of producing a fibrous, non-woven structure, comprising:

stabilizing a thin layer of non-woven fibers into a stabilized web;

moving said stabilized web in a machine direction; and contacting said stabilized web with a stream of liquid that is directed from a jet at a pressure of about 400 psi or greater at least partially along or against said machine direction to entangle fibers.

2. The method of claim 1 wherein said fibers comprise cellulose, polyester, rayon, polyolefin, polyvinyl alcohol, or a combination of two or more thereof.

3. The method of claim 1 wherein said thin layer is unbonded prior to said stabilization.

4. The method of claim 1 wherein said stabilizing step comprises contacting said thin layer of fibers with a stream of liquid that is substantially perpendicular to said machine direction at the point of contact.

5. The method of claim 4 wherein said stream of liquid is urged from a jet at a pressure from about 500 psi to about 5000 psi.

6. The method of claim 1 wherein said stream of said contacting step is directed at least partially along said machine direction.

7. The method of claim 1 wherein said stream of said contacting step is directed at least partially against said machine direction.

8. The method of claim 1 wherein said stream of said contacting step is directed such that the stream contacts the stabilized web at an angle from about 1 degree to about 45 degrees, wherein said angle is an angle between a first ray that is normal to said machine direction at the point of contact and a second ray that is along the direction of said stream and projected into a plane perpendicular to said machine direction.

9. The method of claim 8 wherein the angle is between about 15 degrees and about 30 degrees.

10. The method of claim 1 wherein said contacting step comprises urging said liquid stream from a jet at a pressure from about 1000 psi to about 5000 psi.

11. The method of claim 1 wherein said contacting step is sufficient to increase a thickness of said stabilized web.

12. The method of claim 1 wherein said contacting step is sufficient to increase a thickness or decrease a density of said stabilized web by at least about 10%.

13. The method of claim 1 wherein said contacting step is sufficient to increase a thickness or decrease a density of said stabilized web by at least about 40%.

14. The method of claim 1 wherein prior to said stabilizing, said thin layer of fibers are carded.

15. The method of claim 1 wherein said contacting step is sufficient to provide a fibrous, non-woven structure with a drapeability of at least about 4 gsm/g and a density less than about 0.08 g/cc.

16. The method of claim 1 wherein said contacting comprises urging said liquid stream from a jet at a pressure of about 750 psi or greater.

* * * * *